US006138772A

United States Patent [19]

Miescher et al.

[11] Patent Number: 6,138,772

[45] Date of Patent: Oct. 31, 2000

[54] DRILL WITH A HAMMER MECHANISM

[75] Inventors: Stefan Miescher, Eschen, Liechtenstein; Fritz Mark, Mäder, Austria

[73] Assignee: Hilti Aktiengesellschaft, Schaan, Liechtenstein

[21] Appl. No.: 09/311,886

[22] Filed: May 14, 1999

[30] Foreign Application Priority Data

May 14, 1998 [DE] Germany ..... 198 21 554

[51] Int. Cl.[7] ..... B25B 23/157

[52] U.S. Cl. ..... 173/93.5; 173/109; 173/205

[58] Field of Search ..... 173/109, 122, 173/124, 93, 93.5, 205, 48, 93.6, 114, 104

[56] References Cited

U.S. PATENT DOCUMENTS

| | | | |
|---|---|---|---|
| 2,753,965 | 7/1956 | Kaman | 173/205 |
| 3,270,821 | 9/1966 | Bassett et al. | 173/205 |
| 4,085,337 | 4/1978 | Moeller | 173/205 |
| 4,653,359 | 3/1987 | Liao | 173/93 |
| 4,712,456 | 12/1987 | Yuan | 173/93.5 |
| 4,820,088 | 4/1989 | Ooki et al. | 173/104 |

*Primary Examiner*—Scott A. Smith
*Attorney, Agent, or Firm*—Brown & Wood, LLP

[57] ABSTRACT

A drill including a hammer mechanism (7) for generating axial blows to be imparted to a tool (6) receivable in a drill spindle, with the hammer mechanism (7) including a first cam disc (11) connected with the spindle (5) for joint rotation therewith, a second cam disc (12) supported in a drill housing (1) without a possibility of rotation relative thereto but with a possibility of axial displacement therein and having a projection (22) extending through the first cam disc (11) and into the spindle (5) for imparting the axial blows to the tool (6) which is received in the working spindle (5) with a possibility of a limited axial displacement relative thereto, a first spring (14) located between a surface (13) of the second cam disc (12) facing in the direction opposite to the drilling direction and a surface in the housing (1) facing in the drilling direction for biasing the second cam disc (12) into the drilling direction, a second spring (23) located between the surface (13) of the second cam disc (12) and a working surface (18) of the adjusting element (19) for further biasing the second cam disc (12) into the drilling direction and an operational point of which is displaced into an operating region of the first spring (14) by adjusting element (19) displaceable parallel to the drilling direction.

8 Claims, 3 Drawing Sheets

DRILL WITH A HAMMER MECHANISM

BACKGROUND OF THE INVENTION

1. Field of the Invention

The present invention relates to a drill having a housing, a working spindle for receiving a tool and rotatably supported in the housing, and a hammer mechanism for generating axial blows to be imparted to the tool, with the hammer mechanism including a first cam disc connected with the working spindle for joint rotation therewith, a second cam disc supported in the housing without a possibility of rotation relative thereto but with a possibility of axial displacement therein, a spring located between a surface of the second cam disc facing in the direction opposite to the drilling direction and a surface in the housing facing in the drilling direction for biasing the second cam disc into the drilling direction, and an adjusting element for adjusting blow power of the axial blows imparted to the tool and displaceable parallel to the drilling direction.

2. Description of the Prior Art

For boring of stone, concrete and similar materials together with heavy boring and chisel tools also lighter and smaller boring, drilling and the like tool, which are equipped with a mechanical hammer mechanism that imparts blows to the tool only upon contact of the tool with a treated material under pressure, are used. Such a tool is disclosed in German Patent No. 1,427,725. The tool disclosed in the German Patent has a rotatable and axially displaceable working spindle and a cam hammer mechanism with cam discs slidable over each other. The working spindle is connected with an adjusting element for joint axial displacement therewith and is connected with a drive gear and one of the cam discs for joint rotation therewith. The other cam disc is fixedly secured in the tool housing. The adjusting element is formed as a sleeve-shaped member. It surrounds both cam discs and is displaced in the drilling direction by a spring.

The adjusting element cooperates with a control element which is located between the adjusting element and a surface in the housing facing in the drilling direction. The control element and the adjusting element have turned toward each other, end surfaces provided with corresponding spiral and ascending surfaces which, upon rotation of the adjusting element, slide over each other and determine, dependent on the degree of rotation of the adjusting element, the axial position of the working spindle defined by the axial position of the control surfaces. In this way, the blow power of the hammer mechanism is changed, or the cam elements of both cam disc are disengaged and no axial blows are imparted to the working spindle. The imparting of axial blows to the working tool via the working spindle results in an increased loss of the impact power and in an early wear of the working spindle and of the supports provided in the tool for supporting the working spindle.

Accordingly, the object of the present invention is to provide a boring tool or a drill in which the axial blows generated by the hammer mechanism are transmitted by the hammer mechanism directly to the working tool received in the spindle,and in which an increase of the blow power can be achieved simply and rapidly.

SUMMARY OF THE INVENTION

These and other objects of the present invention, which will become apparent hereinafter, are achieved by providing the second cam disc with a projection, which extends through the first cam disc and into the working spindle for imparting axial blows directly to the working tool received in the spindle with a possibility of a limited axial displacement relative to the spindle, and by providing a second spring located between the surface of the second cam disc and a working surface of the adjusting element for further biasing the second cam disc into the drilling direction, and having its operating point displaced into an operating point region of the first spring by the adjusting element.

With a hammer mechanism according to the present invention, the axial blows are imparted to a working tool, which is received in the working spindle with a possibility of a limited axial displacement relative to the spindle, by a projection which extends from the second cam disc and imparts blows to the rear end of the working tool upon displacement of the second cam disc in the drilling direction. In order to displace the second cam disc in the drilling direction with a force exceeding the biasing force of the first spring, a second spring is displaced by the adjusting element into the operating region of the first spring. The second spring, upon the displacement of the second cam disc in the direction opposite to the drilling direction, is preloaded with a time-delay with respect to preloading of the first spring. Thus, the force, which is available for displacing or accelerating the second cam disc in the drilling direction and which is stored in the preloaded spring, consists mainly of the spring force of the first spring and a portion of the spring force of the second spring.

Advantageously, the operating point of the second spring is displaced by the adjusting element so that it coincides with the operating point of the first spring. Thereby, at the beginning of the displacement of the second cam disc in the direction opposite to the drilling direction by the first cam disc, both springs are preloaded simultaneously. The blow power of the axial blows imparted to the working tool by the second cam disc in this case consists of spring power of both springs.

Based on operational considerations, preferably, for displacement of the adjusting elements, there are provided rotatable relative to each other, control elements with control surfaces which are arranged between the adjusting element and a surface of the housing. The control surfaces, e.g., are provided on turned toward each other, axially spaced end surfaces of the adjusting element and a control element fixedly secured in the housing and located between the adjusting element and the surface of the housing. Upon rotation of the adjusting element in a circumferential direction, the control surfaces slide over each other and, dependent on the degree of rotation, change the axial position of the adjusting element relative to the second cam disc or change the distance between the second spring and the second cam disc. An automatic rotation of the adjusting element is prevented when, advantageously, the control elements are stepwise offset relative to each other in a direction parallel to the drilling direction.

In order to be able to noticeably increase the blow power, which is generated by the first spring, preferably, the spring force of the second spring is larger than the spring force of the first spring.

In order that the second spring be able to operate only in a predetermined spring force region if it is displaced, together with the first spring, by the second cam disc, upon the displacement of the second cam disc in the direction opposite to the drilling direction, preferably, the adjusting element is formed as a sleeve-shaped member, and the second spring is arranged, with a preload, between the working surface of the adjusting element and a stop member displaceable parallel to the drilling direction and operatively connectable with a surface of the second disc cam facing in the direction opposite to the drilling direction.

In order to provide a good axial support for the first spring and to insure that it has a small length, there is provided a bolt-shaped guide element which projects from a surface of the housing, which faces in the drilling direction, and extends through both springs. The bolt-shaped guide element has an enlarged section which is located between the working surface of the adjusting element and the surface of the second cam disc facing in a direction opposite to the drilling direction. The enlarged section has a first stop shoulder facing in the drilling direction and against which the first spring is supported.

In order to provide for an automatic displacement of the adjusting element, into its initial position when it is rotated in the circumferential direction, there is provided a third spring which is arranged between the working surface of the adjusting element and the enlarged section of the guide element. The second spring is supported against the second shoulder of the enlarged section facing in the direction opposite to the drilling direction.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
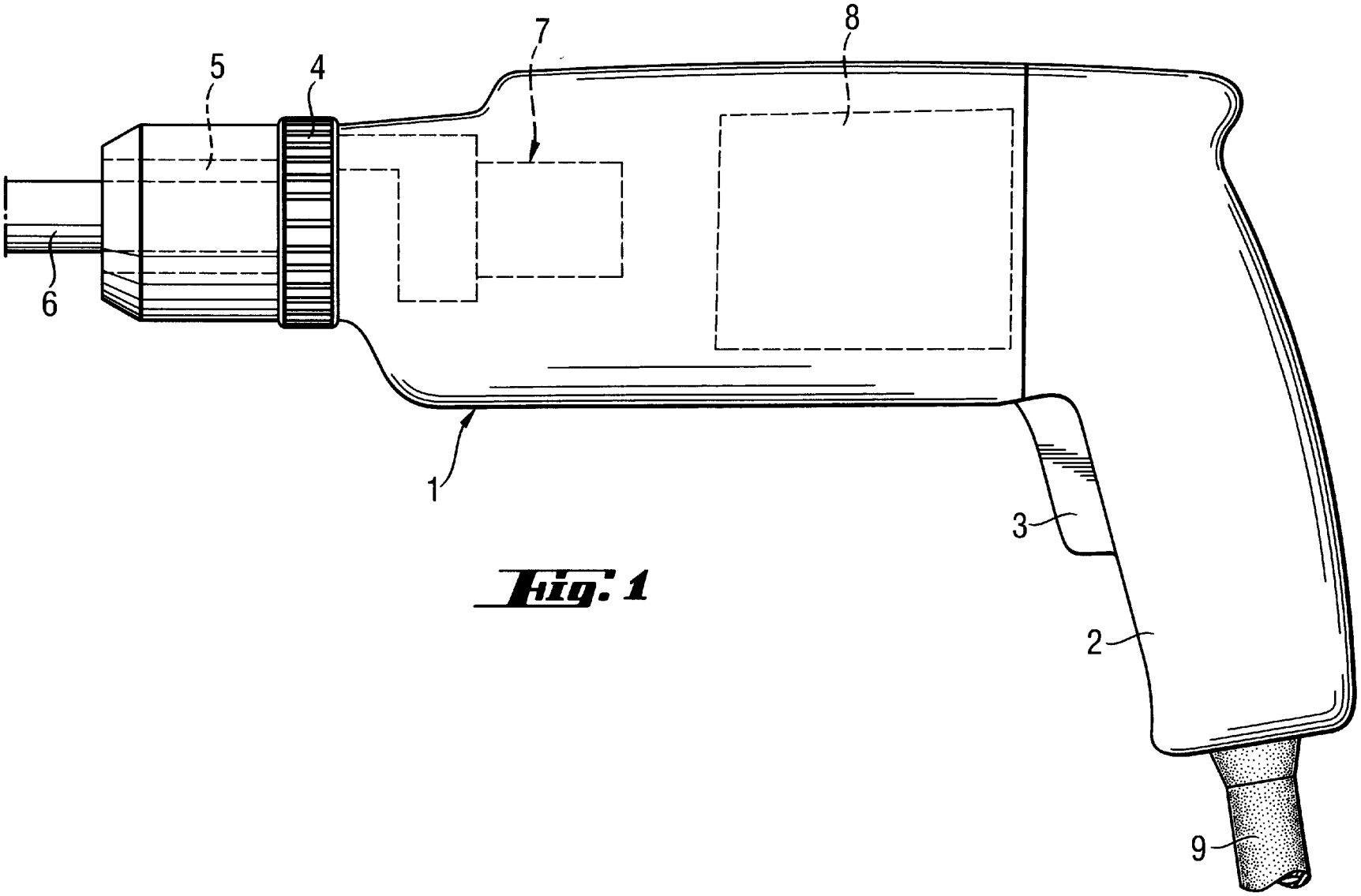
FIG. 1 shows a schematic side elevational view of a drill according to the present invention.

A drill according to the present invention, which is shown in FIG. 1, includes a housing 1, a handle 2, an actuation trigger 2 built into the handle 2, an electrical connection conductor 9, and a work spindle 5 rotatably supported in the housing 1 and designed for receiving a tool 6. The drill further includes a hammer mechanism 7, and an electric drive motor 8 operatively connected with the spindle 5 for rotating the same by rotation transmitting elements, not shown in FIG. 1.

Figure 2:
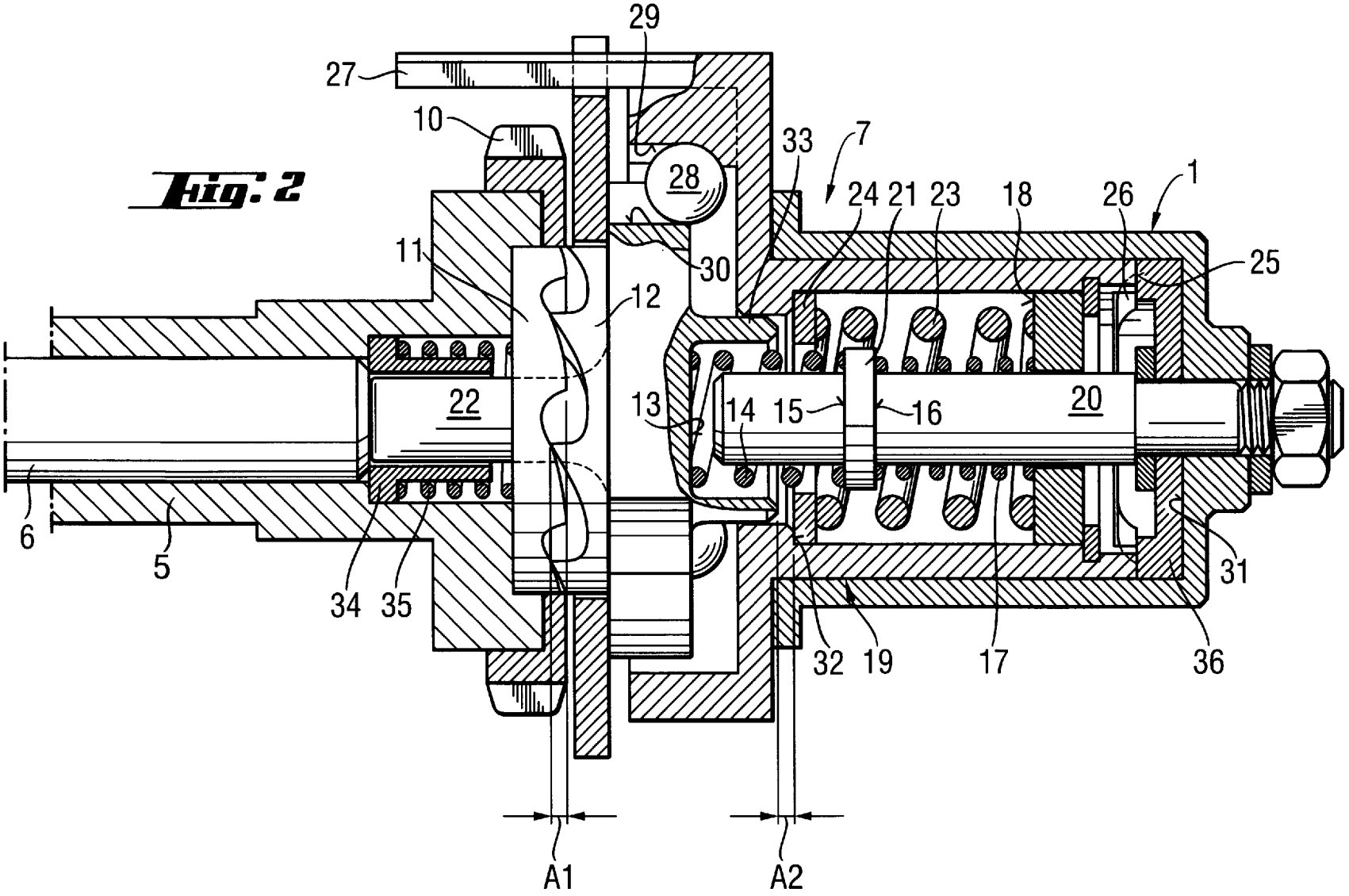
FIG. 2 shows, at an increased scale, a cross-sectional view of a hammer mechanism of the drill shown in FIG. 1, with the adjustment member in an initial position.
Figure 3:
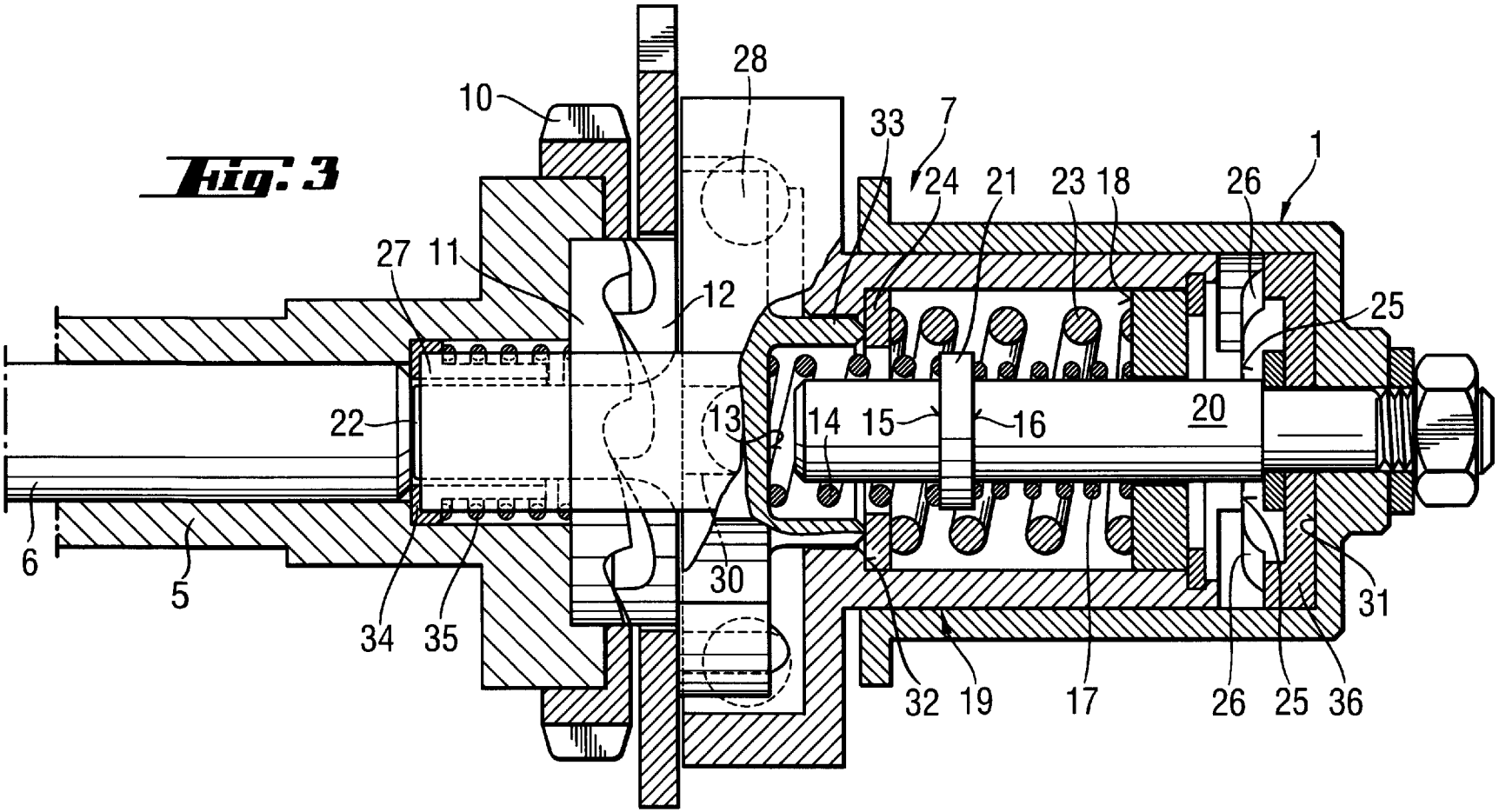
FIG. 3 shows, at an increased scale, a cross-sectional of the hammer mechanism of the drill shown in FIG. 1, with the adjustment member in the end position.

FIGS. 2 and 3 show a portion of the work spindle 5, which is rotatably supported in the housing 1, and the hammer mechanism 7 of the drill according to the present invention. The working spindle 5 has a bore in which the shank of the tool 6 is received. The tool 6 is received in the bore of the working spindle with a possibility of a limited axial displacement relative to the spindle 5. The shank of the tool 6 contains a stop sleeve 34 which is received in a radially widened portion of the spindle 5. The stop sleeve 34 is displaceable, in a direction opposite to the drilling direction, against a biasing force of a spring 35. For the sake of clarity, the stop sleeve 34 and the spring 35 are shown only in FIG. 2. A free end of the work spindle 5, facing in the direction opposite to the drilling direction, is connected with a drive gear 10 for joint rotation therewith. The drive gear 10 has an outer toothing and is driven by the drive motor 8 upon actuation of the drill. The work spindle 5 further has a first cam disc 11 with cam elements in a form of a toothing and extending in a direction opposite to the drilling direction. There is provided in the housing 1 a second cam disc 12 having likewise cam elements in a form of a toothing and extending in the drilling direction. The second cam disc 12 is supported in the housing 1 without a possibility of rotation relative to the housing 1 but with a possibility of an axial displacement relative thereto. During the rotation of the work spindle, the cam elements of the first cam disc 11 slides over the cam elements of the second cam disc 12 or plunge into the depressions between the cam elements of the second cam disc 12. The second cam disc 12, in short time intervals, is alternatively displaced, in the direction opposite to the drilling direction, against a biasing force of a spring 14 and is jerkwise displaced, in the drilling direction, by the preloaded spring 14 toward the cam disc 11.

The second cam disc 12 is supported in the housing 1 against rotation but for axial displacement by ball-shaped guide members 28 which are uniformly arranged over the circumference of the second cam disc 12. The guide members 28 are displaceable in longitudinal grooves 29, 30 extending parallel to the drilling direction and formed in an adjusting member 19 and in the second cam disc 12, respectively. The grooves 29, 30 have a substantially semicircular cross-section. The longitudinal grooves 29 of the adjusting member 29 are formed in the inner contour of an adjustment arm 27 of the adjusting member 19, and the longitudinal grooves 30 are formed in the outer surface of the second cam disc 12. The length of the grooves 29, 30 corresponds substantially to the diameter of the guide members 28 and an amount of a maximal axial displacement of the second cam disc 12 in the direction parallel to the drilling direction.

A bolt-shaped guide element 20 projects from a housing surface 31 facing in the drilling direction. The guide element 20 has widened section 21 which forms first and second stop shoulders 15 and 16 facing, respectively, in a drilling direction and in a direction opposite to the drilling direction. The spring 14 extends between a surface 13 of the second cam disc 12, which faces in the direction opposite to the drilling direction, and the stop shoulder 15. Upon the axial displacement of the second cam disc 12 by the first cam disc 11 against the biasing force of the spring 14, the spring 14 becomes preloaded.

The adjusting element 19 is sleeve-shaped, and it surrounds the bolt-shaped guide element 20. Between the enlarged portion 21 and the surface 31 of the housing 1, the adjusting element 19 has a working surface 18. A spring 17 is arranged between the working surface 18 and the second stop shoulder 16 of the guide element 20. Adjacent to the working surface 18, the adjusting element 19 has a stop edge 32 with a support surface facing in a direction opposite to the drilling direction. A stop member 24, which is displaceable in the direction opposite to the drilling direction and which is formed as an ring washer is supported against the support surface formed by the stop edge 32.

The stop member 24 cooperates with a spring 23 which is arranged, with a preload, between the stem member 24 and the working surface 18 and which surrounds a portion of the spring 14 and the spring 17. The biasing force of the spring 14 is smaller than the biasing force of the spring 23 but is larger than the biasing force of the spring 17.

A portion of a surface 13 of the second cam disc 12, which faces in the direction opposite to the drilling direction, is formed by an end surface of a tubular projection 33 extending in the direction opposite to the drilling direction. An axial distance A2 between the end surface of the tubular projection 33 and the displaceable stop member 24 corresponds, in an initial position of the drill, to a maximum displacement Al of the second cam disc 12 parallel to the drilling direction.

In the drill according to the present invention, the increase of the blower power is achieved by displacement of an operating point of the spring 23, which partially surrounds the spring 14, which acts on the second cam disc 12, into a region of an operating point of the spring 14. The axial displacement of the spring 23, which is necessary for achieving a high blower power, is effected with the adjusting element 19 and a stationary control member 36 located between the adjusting element 19 and a surface 31 of the housing 1. The turned toward each other, end surfaces of the adjusting element 19 and the control member 36 have at least two, axially spaced from each other, control surfaces 25, 26. Upon rotation of the adjusting element 19, the control surfaces 25, 26 slide over each other. The axial position of the control surfaces 25, 26, which depends on the degree of rotation of the adjusting element 19, determines the axial position of the adjusting element 19 or a distance of the spring 23 from the second cam disc 12. In the preferred embodiment of the invention, the end surfaces of the adjusting element 19 and of the control member 36 have, respectively, three, axially spaced from each other, control surfaces 25, 26, with only two control surfaces 25, 26, respectively, being shown in FIGS. 2 and 3.

Dependent on the degree of rotation of the adjusting element 19, the operating point of the spring 23 is displaced into the operating region of the spring 14 or coincides with the operating point of the spring 14. Starting point or a zero point of a spring characteristic determines the operating point, and the spring excursion determines the operating region of a spring. When the operating point of the spring 23 is displaced in the operating region of the spring 14, the energy of the blow power initially is defined by the biasing force of the spring 14 and then by the biasing forces of both the spring 14 and the spring 23. When the operating point of the spring 23 coincides with the operating point of the spring 14, the energy of the blow power is always defined by the biasing forces of both springs 14 and 23.

A projection of the second cam disc 12 extends through the first cam disc 11 and into the spindle 5 and imparts axial blows to the rear end of a tool dependent on the rotational speed which determines sliding of the cam discs 11 and 12 over each other.

Changing of the blower power of the hammer mechanism 7 is effected, as it has already ben described previously, by rotating the adjusting element 19 in the circumferential direction. A simple and rapid rotation of the adjusting element 19 can be effected, e.g., with a rotatable, in the circumferential direction, adjusting ring 4, which is provided on the outside of the drill and which is formlockingly connected with the adjusting arms 27 of the adjusting element 19.

An overload clutch (not shown), e.g., is provided between the working spindle 5 and the drive gear 10. The overload clutch provide for interruption of a transmission of the rotational movement from the electrical drive motor 8 to the working spindle 5 when, e.g., the drilling tool, while forming a bore in a structural component, encounters a reinforcing iron and becomes jammed.

Though the present invention was shown and described with references to the preferred embodiments, various modifications thereof will be apparent to those skilled in the art and, therefore, it is not intended that the invention be limited to the disclosed embodiment or details thereof, and departure can be made therefrom within the spirit and scope of the appended claims.

What is claimed is:

1. A drill, comprising a housing (1); a working spindle (5) for receiving a tool (6) and rotatably supported in the housing (1); and a hammer mechanism (7) for generating axial blows to be imparted to the tool (6), the hammer mechanism (7) including:

first cam disc (11) connected with the working spindle (5) for joint rotation therewith, a second cam disc (12) supported in the housing (1) without a possibility of rotation relative thereto but with a possibility of axial displacement therein and having a projection (22) extending through the first cam disc (11) and into the working spindle (5) for imparting the axial blows to the tool (6) which is received in the working spindle (5) with a possibility of a limited axial displacement relative thereto, the first cam disc (11) sliding over the second cam disc (12) upon rotation of the working spindle (5) for displacing the second cam disc (12) in a direction opposite to drilling direction, a first spring (14) located between a surface (13) of the second cam disc (12) facing in the direction opposite to the drilling direction and a surface in the housing (1) facing in the drilling direction for biasing the second cam disc (12) into the drilling direction, an adjusting element (19) for adjusting blow power of the axial blows imparted to the tool (6), displaceable parallel to the drilling direction and having at least one working surface (18), and a second spring (23) located between the surface (13) of the second cam disc (12) and the working surface (18) of the adjusting element (19) for further biasing the second cam disc (12) into the drilling direction, the adjusting element (19) displacing an operational point of the second spring (23) into an operating region of the first spring (14).

2. A drill according to claim 1, wherein the adjusting element (19) displaces the operating point of the second spring (23) in the drilling direction into the operating point of the first spring (14).

3. A drill according to claim 1, further comprising controlling elements rotatable relative to each other, having control surfaces (25, 26), and arranged between a surface of the housing (1) and the adjusting element (19) for displacing the adjusting element (19).

4. A drill according to claim 3, wherein the control surfaces (25, 26) of the control elements are stepwise offset relative to each other in a direction parallel to the drilling direction.

5. A drill according to claim 1, wherein the second spring (23) has a spring force which is greater than a spring force of the first spring (14).

6. A drill according to claim 1, wherein the adjusting element (19) is formed as a sleeve-shaped member, and the second spring (23) is arranged, with a preload, between the working surface (18) and a stop member (24) located in the sleeve-shaped adjusting element (19), displaceable parallel to the drilling direction, and movable into an operating connection with the surface (13) of the second disc cam (12) facing in the direction opposite to the drilling direction.

7. A drill according to claim 1, further comprising a bolt-shaped guide element (20) projecting from a surface of the housing (1) and extending through both first and second springs (14, 23), the guide element (20) having an enlarge section (21) located between the surface (13) of the second cam disc (12), which faces in the direction opposite to the drilling direction, and the working surface (18) of the adjusting element (19), the enlarged section (21) has a first facing in the drilling direction, stop shoulder (15) against which the first spring (14) is supported.

8. A drill according to claim 7, wherein the enlarged section (21) of the guide element (20) has a second stop shoulder (16) facing in the direction opposite to the drilling direction and against which a third spring (17) is supported, the third spring (17) extending between the stop shoulder (16) and the working surface (18) of the adjusting element (19) for biasing the adjusting element (19) in the direction opposite to the drilling direction.

* * * * *